United States Patent [19]

Alexander

[11] Patent Number: 4,637,291

[45] Date of Patent: Jan. 20, 1987

[54] COMBINATION AMMUNITION RELOADING DIE

[75] Inventor: Kenneth L. Alexander, Oroville, Calif.

[73] Assignee: Omark Industries, Inc., Portland, Oreg.

[21] Appl. No.: 827,864

[22] Filed: Feb. 10, 1986

[51] Int. Cl.[4] ..... F42B 33/10; F42B 33/00

[52] U.S. Cl. ..... 86/23; 29/1.32; 86/24; 86/28; 86/36; 86/37; 86/40; 86/43; 86/1.1

[58] Field of Search ..... 86/1.1, 36, 37, 23, 86/24, 28, 40, 39, 43, 44; 29/1.32, 1.31, 1.3, 1.2

[56] References Cited

U.S. PATENT DOCUMENTS

| | | | |
|---|---|---|---|
| 1,933,940 | 11/1933 | Sutton | 86/28 |
| 2,700,915 | 2/1955 | Pattison | 86/39 |
| 3,033,070 | 5/1962 | Thompson | 86/28 |
| 3,440,923 | 4/1969 | Purdie | 86/43 |
| 3,580,127 | 5/1971 | Lee | 86/43 |
| 3,693,497 | 9/1972 | Jacobitz | 86/28 |
| 4,189,980 | 2/1980 | Schaenzer | 86/24 |
| 4,385,546 | 5/1983 | Lee | 86/43 |
| 4,522,102 | 6/1985 | Pickens | 86/28 |
| 4,566,366 | 1/1986 | Lee | 86/28 |

*Primary Examiner*—John F. Terapane
*Assistant Examiner*—Howard J. Locker
*Attorney, Agent, or Firm*—Robert L. Harrington

[57] ABSTRACT

A combination ammunition re-loading die having an elongated housing. The housing is externally threaded at both ends to enable entry of either end into the die holder of a reloading press. An expander post is integrally formed at one end of the housing. The other end is provided with a cartridge receiving end opening. A threaded opening in the post receives a threaded shaft projected through to the cartridge receiving end opening. The projected end of the shaft carries a re-loading member, e.g. a bullet seating plug or de-priming pin. The shaft is adjustable within the post opening to adjust the position of the member. The housing can be inserted in the die holder to first present the expander post to the cartridge, and then inverted to present the bullet seating plug or de-priming pin.

6 Claims, 4 Drawing Figures

COMBINATION AMMUNITION RELOADING DIE

FIELD OF THE INVENTION

This invention relates to reloading dies used to reload center fire cartridges, and more particularly to a die that serves a combination of functions in the reloading process.

BACKGROUND OF INVENTION

The process of reloading cartridges is most frequently practiced by the hobbyist who wants to tailor-make his own ammunition, or the frequent shooter who wants to save money by reloading his own cartridges. Reloading equipment can be purchased that will mount to a homeowners workbench, and reloading components (powder, primers, bullets) can be puchased for the specific purpose of being used with this reloading equipment.

The reloading equipment e.g. for reloading hand gun cartridges, includes a press that is typically adapted to be mounted to a workbench, but some versions are also of a hand held variety. The press includes a die holder, a cartridge holder, and mechanism for relative movement of the die holder toward and away from the cartridge holder. A plurality of dies are selectively mounted in the die holder and a cartridge is mounted in the cartridge holder. In sequence, the cartridge is forced into the successively mounted dies to;

(a) size the cartridge (prior firing will have caused some bulging);
(b) remove and replace the spent primer;
(c) expand the cartridge mouth to receive a bullet;
(d) insert the bullet;
(e) crimp the cartridge mouth around the bullet for secure holding of the bullet in the cartridge.

The above functions are typically accomplished with three dies, each of which has a generally cylindrical configuration. The first die has an inside shape that is the desired outside shape of the cartridge case (with some allowance for spring back of the cartridge case). Forcing the spent cartridge case into the die reshapes the outer configuration of the cartridge to fit the firing chamber of the firearm for which the cartridge is intended. This same die may include a pin that is inserted into the center of the cartridge as the cartridge is being re-sized, to impact the spent primer and force it out of the cartridge case.

A second die is oversized to easily surround the cartridge. An expander rod is carried inside the die. It enters the mouth of the cartridge and flares the mouth slightly for receiving a bullet.

A third die carries a bullet seating plug on the end of a rod. A bullet is placed into the flared mouth of the cartridge case and then the cartridge is inserted into the die. The seating plug engages and forces the bullet a desired depth into the case and then a crimping shoulder in the die engages and crimps the edge of the case around the bullet.

SUMMARY OF INVENTION

The reloading of the cartridge has to be precise and each of the dies is produced with precision and at substantial cost. The present invention substantially reduces the overall cost of the dies by reducing the number of required dies. This is accomplished by producing a combination die having an outer shape such that it can be mounted to the press with either end positioned for receiving the cartridge case. Fashioned at one end of the die is a post that is integrally formed from the die. The post is designed to enter and expand the mouth of the cartridge. A threaded opening through the post receives the threaded shank of a rod that projects through to the other end of the die. The end of the projected rod can have a seating plug that is designed to engage and seat a bullet, or a pin that serves to dislodge and eject the fired primer, depending on which particular functions are paired in the combination die.

The following example is a preferred embodiment and illustrates the situation wherein the case mouth expansion function is combined with the bullet seating and crimping function. The die set consists, therefore, of a first die that sizes and de-primes the cartridge and a combination die that expands the cartridge mouth on one end and seats and crimps the bullet on the other end.

With the cartridge case sized by the first die, the combination die is mounted to the press with the end having the expander post facing the cartridge case. The press is closed to expand the cartridge mouth. Then the die is removed, inverted and remounted with the seating plug now facing the cartridge. A bullet is set into the expanded mouth of the cartridge case and the press is closed to cause the seating plug to engage and force the bullet inside the cartridge case. A shoulder portion inside the die is positioned to engage the end of the cartridge case just as the bullet is fully seated to thereby crimp the case end around the bullet.

All of the functions of the second and third "typical" dies sare thus accomplished with a single die, all at a substantially reduced cost to the re-loader. The reader will more fully appreciate the advantages of this improved concept by reference to the following detailed description, having reference to the accompanying drawings wherein.

Figure 1:
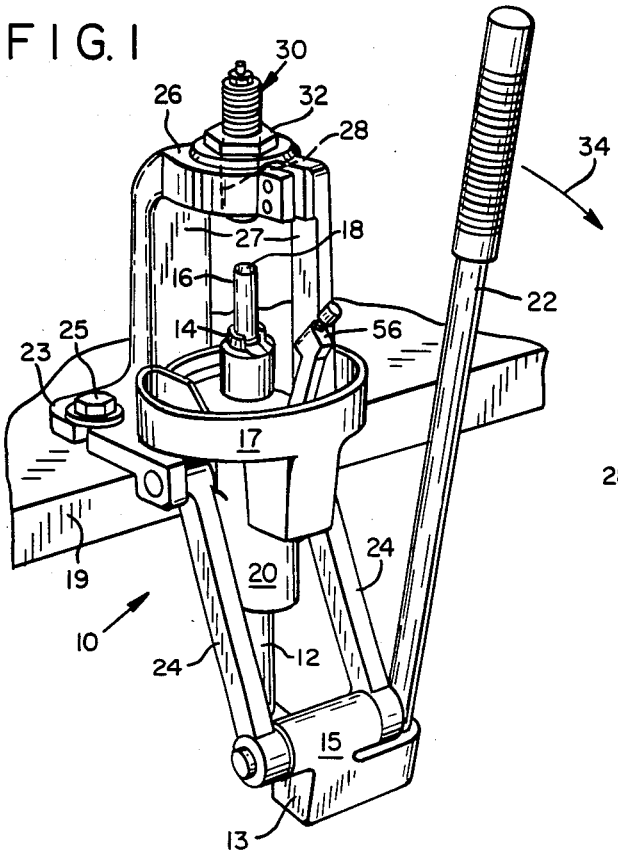
FIG. 1 illustrates the reloading apparatus which utilizes reloading dies of the present invention.

Referring to FIG. 1 of the drawings, illustrated therein is a press 10 including a base member 20 having a bracket portion 23 that securely mounts the base (by screws 25) to a work bench 19. A tray 17 for catching ejected primers, is secured to the base member 20. Guide openings through the base member 20 slidably guide a post 12. The post 12 is pivotally mounted at it's lower end to an off center portion 13 of a pivotable shaft 15 that is journaled at it's ends to arms 24 projected downward from the base member 20 and bracket 23. Pivoting of shaft 15 to force up and down movement of the post 12 is accomplished by pivoting a handle 22 as indicated by arrow 34.

The upper end of post 12 is provided with a cartridge holder 14 designed to hold a cartridge 16 with the mouth 18 of the cartridge facing upwardly as illustrated. A die holder 26 is mounted, through support braces 27, in an elevated position above base member 20. The die holder 26 includes a threaded opening 28 (shown in dotted lines) that is precisely aligned over the position of the cartridge 16. The threaded opening is designed to threadedly receive any of a series of dies, represented in FIG. 1 by die 30 (i.e. one of the dies 30*a* or 30*b* of FIGS. 2 and 3).

In operation, the desired die is screwed into the threaded opening 28 to the proper depth, and lock nut 32 secures the die at that depth. A cartridge 16 is mounted in the cartridge holder 14 and handle 22 is pivoted downwardly as illustrated by arrow 34. This forces sliding of post 12 upwardly through the base member 20 and toward the die holder 26. Cartridge 16, with it's mount portion 18 in lead, is forced into the die 30 and the desired die operation is achieved.

It is to be understood that the above illustration and description is generally typical of reloading apparatus. It is provided to aid in the understanding of the invention which relates to a particular type of die for use in such apparatus. Further illustration and description of the apparatus and its operation are not necessary for an understanding of the invention and is not provided herein.

Figure 2:
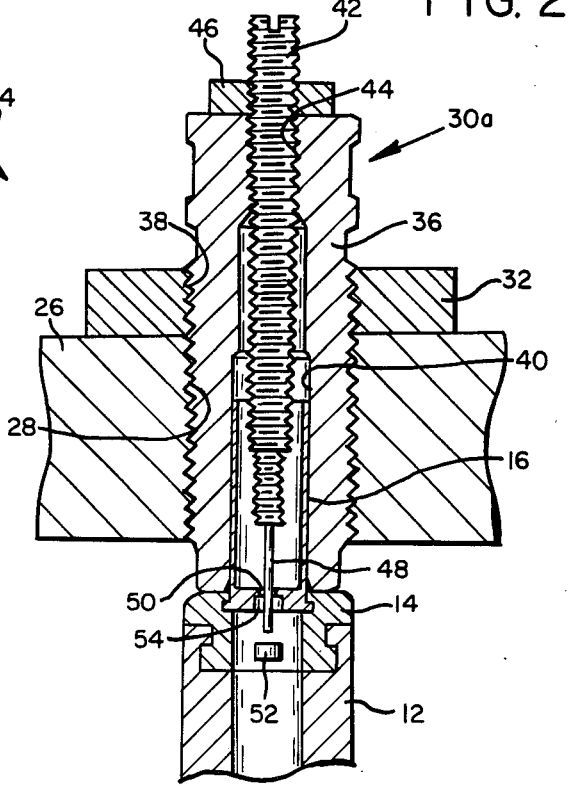
FIG. 2 illustrates, in cross section, one of the reloading dies used in the apparatus of FIG. 1 (but not a die of the present invention)

FIG. 2 illustrates a typical first die 30*a* used in a reloading operation. A die body or housing 36 is provided with external threads 38 and sized to threadedly mate with threaded opening 28 in die holder 26. The bottom section of the die is provided with a precise opening 40 that is the desired outer shape of the cartridge 16. Thus as the cartridge 16 is forced into the inner opening of die 30*a*, the cartridge is drawn down to the desired configuration.

Also provided in the die 30*a* is a primer removing shaft 42. The upper section of the die 30*a* is provided with an internally threaded opening 44 that mates wtih the threaded exterior of shaft 42. Thus the shaft 42 is threadedly positioned within the die 30*a* to a desired position and locked in place by a lock nut 46. The downwardly projected end of the shaft 42 is provided with a primer removing pin 48 that is configured to project through the ignition port 50 of the cartridge and engage a primer 52 seated in the base end of the cartridge. (Note that illustration FIG. 2 shows the primer 52 having been forced out of it's pocket 54 in the cartridge.) Thus, with the operations of FIG. 2 being completed, the cartridge 16 is ready for the reloading operations which will now be described and which utilize a combination die of the present invention.

Before describing the combination die of the invention, the reader will understand that a re-priming operation is typically performed at this point in the reloading process and includes the utilization of a re-priming mechanism 56, shown generally in FIG. 1. This operation will not be described as again it is a well known process using currently available re-priming tools e.g. mechanism 56.

Figure 4:
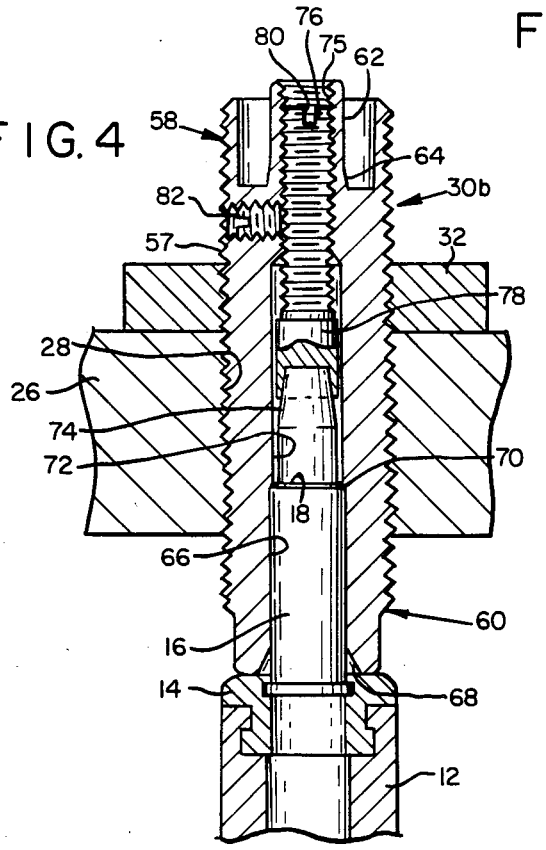
FIG. 4 illustrates, in cross section, the reloading die of FIG. 3 in a second reloading operation.
Figure 3:
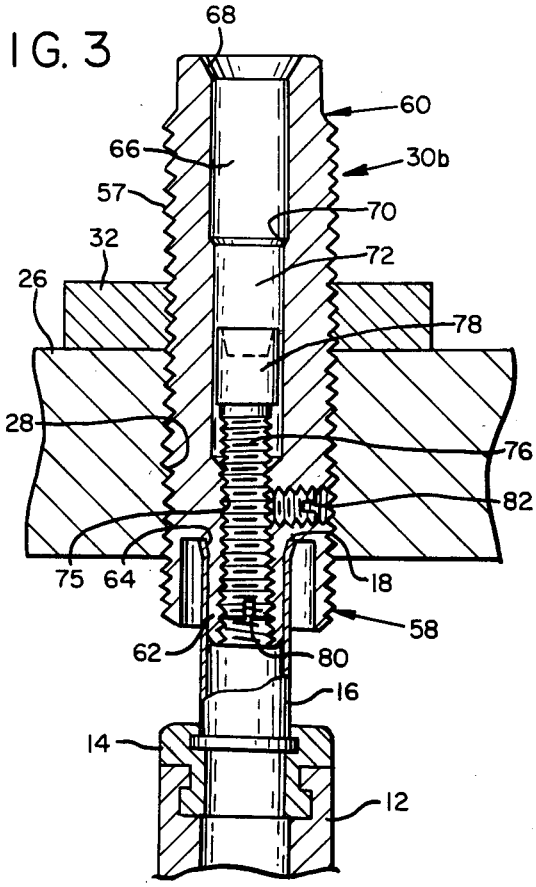
FIG. 3 illustrates, in cross section, a reloading die of the present invention performing a first reloading operation.

Reference is now made to FIGS. 3 and 4 which illustrate a combination die 30*b* of the invention in each of it's two die end functions. Die 30*b* includes a housing of a general cylindrical form having external threading 57 mated to the internal threading of opening 28 in the die holder 26. It will be observed that threading 57 forms the extreme outer dimension throughout the length of the housing so that the die 30*b* can be inserted into the die holder from either end.

The die 30*b* is designed to perform one function with end 58 facing the cartridge 16 (FIG. 3), and a second function with end 60 facing the cartridge 16 (FIG. 4). Located at end 58 is a post 62 that is partially set into the end of the housing and preferably integral with the housing wall. Post 62 can however be formed externally to die 30*b* rather than internally as shown in FIGS. 3 and 4. The configuration depends on the length of the cartridge case being re-loaded. Cartridge cases one inch or longer in length generally require the inset configuration in order to provide a sufficient length of threading 57.

Post 62 has an outer configuration that is the internal diameter of the cartridge 16 but is slightly flared outwardly at it's base 64. Refer to FIG. 3 (wherein end 58 is functional) and note that as the post 62 is forced into the cartridge 16, just as the cartridge 16 is bottomed on the post, flared portion 64 forces a flaring of the mouth 18 of the cartridge 16. The purpose of the flared mouth is for aiding in the bullet seating operation, the function of end 60, which will now be explained.

End 60 is provided with end opening 66 that is closely matched to the external shape of the cartridge (see FIG. 4). A flared entry 68 is provided for opening 66. Located at the inner end of opening 66 is a shoulder 70 preceding an opening 72 of reduced diameter (but large enough to accommodate a bullet 74). The post 62 is provided with a threaded opening 75 and forms a further continuation of reduced opening through the housing of die 30*b*. A threaded shaft 76 is screwed into the threaded opening 75 from end 60 and carries a bullet seating plug 78 (at the end of the shaft projected toward end 60). Shaft 76 is adjustable (a screwdriver slot 80 is provided in the end opposite plug 78), to adjust the position of bullet plug 78 within opening 72. A lock screw 82 locks the shaft 76 with the plug 78 at the desired position.

Referring now to FIG. 4, it will be understood that following the mouth flaring operation of FIG. 3, the handle 22 is raised to the position of FIG. 1 to separate die holder 26 (and the die carried thereby) from the cartridge holder 14 (and cartridge 16 carried thereby). The mouth 18 of the cartridge being slightly flared allows the re-loader/user to first insert the desired amount of powder and then set a bullet 74 into the flared portion of the mouth. The die is unscrewed from the die holder (after loosening nut 32), inverted and re-screwed into the die holder with end 60 now facing the cartridge. With the bullet 74 projected out of the cartridge mouth, the handle 22 is lowered (arrow 34) to insert the bullet and cartridge into opening 66 of the die. As the flared mouth of the cartridge engages flared entry 68 of opening 66, the cartridge mouth is straightened and partially formed around bullet 74. The bullet then engages bullet plug 78 which restricts further movement of the bullet into the die. Continued advancement of the cartridge (with continued pivoting of handle 22) now forces the bullet into the cartridge mouth until a full seating of cartridge holder 14 against the end of the die stops such movement. In coordination with full seating, the mouth of the cartridge engages the shoulder 70 which crimps the outer edge of the cartridge mouth around the bullet.

The basic function described above i.e. insertion of post 62 into the cartridge mouth to flare the mouth, and seating a bullet in the cartridge (and simultaneously crimping the cartridge to the bullet), are not new to a reloading operation. What is new is the provision of these die functions within the same die unit. Thus the invention encompasses the provision of an integral post member at one end with a shaft receiving opening through the post to provide for an adjustable shaft carrying a bullet seating plug projected toward the opposite end. Thus the same die body accommodates at it's respective reversible ends, dual die functions. This dual die function feature achieves the much desired benefit of substantially reducing the cost to the end user.

The invention is shown in the preferred embodiment and others, having knowledge of the art, will likely conceive of variations and modifications without departing from the invention. Note for example that shaft 76 of FIG. 4 and shaft 42 of FIG. 2 are interchangeable in the die 30*b*. All that is necessary is to conform end 60 of die 30*b* so as to provide the cartridge sizing function rather than the bullet seating function. Two dies would still be required but the combined functions of the combination die would then function to (a) size the cartridge, (b) remove the primer, and (c) (following inversion of the die) expand the cartridge mouth. The "single ended" die would then (d) insert the bullet and (e) crimp the cartridge mouth. Accordingly, the invention is encompassed by the definition of the claims and is not to be restricted to the specific embodiment illustrated in the drawings.

I claim:

1. A combination ammunition re-loading die adapted to be threadedly mounted to the die holder of an ammunition re-loading apparatus comprising; an elongated housing having first and second ends, an outer threaded surface formed at each of said first and second ends whereby said housing can be threadedly mounted to the die holder by the selective insertion of the first and second ends, a cartridge mouth expander post provided at said first end adapted to engage and flare open the mouth of a cartridge held in the reloading apparatus, the second end of the housing having a cartridge receiving opening extending inwardly through the housing to said post at said first end, said post having a shaft receiving threaded opening forming a continuation of the cartridge receiving opening in the second end, a shaft screwed into said post opening with an end portion positioned in said second end opening, a cartridge reloading member provided on said end of the shaft and positioned in said second end opening of the housing, said cartridge reloading member being adjustably positioned within said second end opening of the housing by screwing the shaft into and out of the post opening, and locking means to lock the shaft at a desired position in the post opening.

2. A combination ammunition re-loading die as defined in claim 1 wherein the cartridge re-loading member is a bullet seating plug.

3. A combination ammunition re-loading die as defined in claim 1 wherein the cartridge receiving opening functions as a sizing die and the cartridge re-loading member is a de-priming pin.

4. A combination ammunition re-loading die as defined in claim 2 wherein said first end of the housing has a cartridge receiving opening and the post is contained substantially within said opening, and a base portion of the post is integrally formed out of the said housing.

5. A combination ammunition re-loading die as defined in claim 4 wherein the entry portion of said second end opening of the housing is flared for engaging and straightening the flared mouth of a cartridge during insertion thereof into the second end opening of the housing.

6. A combination ammunition re-loading die as defined in claim 5 wherein a shoulder portion is provided on the wall of the second end opening of the housing, said shoulder portion positioned within the end opening to crimp the edge of a cartridge mouth around a bullet as the bullet is fully seated in the cartridge.

* * * * *